US005789857A

United States Patent [19]

Yamaura et al.

[11] Patent Number: 5,789,857

[45] Date of Patent: Aug. 4, 1998

[54] FLAT DISPLAY PANEL HAVING SPACERS

[75] Inventors: Tatsuo Yamaura; Yoshio Makita; Mamoru Namikawa; Satoshi Yoshimura; Kenichi Honda, all of Mobara, Japan

[73] Assignee: Futaba Denshi Kogyo K.K., Mobara, Japan

[21] Appl. No.: 559,316

[22] Filed: Nov. 15, 1995

[30] Foreign Application Priority Data

Nov. 22, 1994 [JP] Japan ..... 6-311344
Nov. 22, 1994 [JP] Japan ..... 6-311345

[51] Int. Cl.[6] ..... H01J 1/88

[52] U.S. Cl. ..... 313/495; 313/482; 313/292

[58] Field of Search ..... 313/493, 482, 313/496, 497, 250, 257, 268, 292; 445/24, 25

[56] References Cited

U.S. PATENT DOCUMENTS 4,745,332 5/1988 Tischer ..... 313/495
5,385,499 1/1995 Ogawa et al. ..... 445/24
5,438,240 8/1995 Cathey et al. ..... 313/309
5,551,903 9/1996 Kumar et al. ..... 445/24
5,561,343 10/1996 Lowe ..... 313/496

*Primary Examiner*—Sandra L. O'Shea
*Assistant Examiner*—Vip Patel
*Attorney, Agent, or Firm*—Oblon, Spivak, McClelland, Maier & Neustadt, P.C.

[57] ABSTRACT

A vacuum envelope capable of preventing contamination of an electron source and deterioration of luminous characteristics of a phosphor layer. Electrons emitted from a tip end of emitter cones are accelerated by an anode conductor to which a positive voltage is applied with respect to a gate conductor, to thereby impinge on the phosphor layer, leading to luminescence of the layer. The luminescence is observed through a transparent anode substrate. Spacers are bonded at only one end thereof to a cathode substrate by means of seal glass, to thereby keep the seal glass from being irradiated with electrons.

4 Claims, 7 Drawing Sheets

FLAT DISPLAY PANEL HAVING SPACERS

BACKGROUND OF THE INVENTION

This invention relates to a vacuum envelope for a display device including two glass substrates and a method for manufacturing the same, and more particularly to a vacuum envelope suitable for use for a field emission type display device and a method for manufacturing the same.

When an electric field applied to a surface of a metal material or a semiconductor material is set to be about $10^9$ (V/m), a tunnel effect occurs to permit electrons to pass through a barrier, resulting in the electrons being discharged to a vacuum even at a normal temperature. Such a phenomenon is referred to as "field emission" and a cathode constructed so as to emit electrons based on such a principle is referred to as "field emission cathode".

Recent development of semiconductor processing techniques permits the field emission cathode to be formed into a size as small as microns. Formation of a number of such field emission cathodes on a substrate leads to preparation of a field emission array of the surface discharge type. Also, it is proposed that such a field emission array is used as an electron source for a display device, a CRT, an electronic microscope, an electron beam apparatus or the like.

Now, a conventional field emission type display device (hereinafter also referred to as "FED") which is one of examples to which the field emission array is applied will be described hereinafter with reference to FIG. 5. The conventional FED includes a cathode substrate 1 having a field emission array formed thereon and a transparent anode substrate 5, which are arranged opposite to each other so as to be spaced from each other at a predetermined interval, to thereby form a vacuum envelope, which is then evacuated to a high vacuum.

The field emission array 10 formed on the cathode substrate 1 is constructed into a Spindt-type field emission array which includes a cathode conductor 2 formed by sputtering or the like, a plurality of emitter cones 9 each formed into a conical shape and a gate conductor 8 arranged in proximity to a tip end of the emitter cones 9.

The anode substrate 5 is provided on an inner surface thereof with luminous sections 6, each of which includes an anode conductor 6-1 formed on the anode substrate 5 and a phosphor layer 6-2 laminatedly deposited on the anode conductor 6-1.

The emitter cones 9 are arranged in proximity to each other with a pitch as small as 10 microns or less being defined therebetween. Tens of thousands to hundreds of thousands of such emitter cones are arranged on a single cathode substrate. The field emission array thus formed may be constructed so as to permit a distance between a gate and a cathode to be as small as less than a micron, so that application of a voltage $V_{GE}$ as low as tens of volts between the gate and the cathode may permit electrons to be discharged from the emitter cones 9.

In the conventional FED, a positive voltage $V_A$ is applied to the gate conductor 8, so that electrons emitted from the emitter cones 9 are accelerated along paths indicated at broken lines in FIG. 5 and then captured by the anode conductor 6-1, during which the electrons impinge on the phosphor layer 6-2 laminatedly formed on the anode conductor 6-1 to excite it, leading to luminescence of the phosphor layer 6-2. Such luminescence of the phosphor layer 6-2 is then observed through the transparent anode substrate 5.

In the conventional FED constructed as described above, arrangement of the anode substrate 5 and cathode substrate 1 while maintaining a desired interval of hundreds of microns therebetween is carried out by interposedly holding suitable members such as side plates, glass beads, glass fibers or the like therebetween by means of low-melting frit glass while positioning them at a periphery thereof. Unfortunately, evacuation of the envelope constituted by the anode substrate 5 and cathode substrate 1 to a high vacuum causes the envelope to be inwardly deflected due to an atmospheric pressure externally applied thereto, resulting in the interval therebetween being reduced. In order to solve the problem, a plurality of spacers 3 are arranged between the anode substrate 5 and the cathode substrate 1, to thereby ensure that the interval desired is uniformly maintained therebetween throughout the envelope.

The spacers 3 each are fixedly bonded at one end thereof to the inner surface of the anode substrate 5 by means of seal glass 4 mainly consisting of low-melting frit glass. Likewise, each of the spacers 3 is securely bonded at the other end thereof to the cathode substrate 1 by the seal glass 4. The spacers 3 are arranged at a portion of the FED at which the FEC 10 is not provided so as to be spaced from each other at intervals of about 2 mm.

Now, arrangement of the spacers 3 in the envelope will be described hereinafter with reference to FIGS. 3(*a*) to 4(*c*).

First, as shown in FIG. 3(*a*), hundreds of glass fibers 101 of, for example, 50 μm in diameter for each of the spacers 3 are fixed on a glass base 100 by means of an adhesive while being closely contacted with each other. Such fixing of the glass fibers 101 on the glass base 100 is carried out in a manner to be parallel to a longitudinal axis of the glass base 100. Then, the glass fibers 101 thus fixed are repeatedly cut into a predetermined length of, for example, 200 μm along a cutting line by means of a dicing saw.

The glass fibers 101 thus cut into a predetermined length are positioned with respect to the anode substrate 5 by means of a fixture 110 so as to provide each of the spacers 3 after the adhesive is dissolved and washed by a solvent.

The fixture 110, as shown in FIG. 3(*b*), is formed into a box-like shape and provided at an upper portion thereof with a raising section 111, which is provided with openings 114 each for holding the glass fibers 101 for each of the spacers 3 while raising them. Also, the fixture 110 includes a perforated section 112 made of a perforated material and an evacuation section for permitting air introduced from the openings 114 of the raising section 111 through the perforated section 112 into the fixture 110 to be outwardly exhausted therethrough, leading to evacuation of the fixture 110. The openings 114 are arranged so as to positionally correspond to arrangement of the spacers 3 on the cathode substrate 5.

The evacuation section 113 of the fixture 110 thus constructed is connected to a vacuum pump (not shown) to evacuate the fixture 110 to a vacuum, during which the glass fibers 101 cut as described above are spread on the raising section 111 of the fixture 110. This results in air sucked through the openings 114 through the perforated section 112 into the fixture 110 being outwardly exhausted from the fixture 110 through the evacuation section 113, so that the cut glass fibers 101 may be permitted to forcibly enter the openings 114 of a diameter somewhat larger than a diameter of the glass fibers 101 while being raised and then be kept raised in the openings 114 as shown in FIG. 3(*b*).

In such a state as described above, a glass substrate 120 having a transfer paste 121 coated thereon is arranged on the fixture 110 as shown in FIG. 3(*c*) and contacted with the glass fibers 101 so that the transfer paste 121 may be transferred to an upper end of each of the glass fibers 101 held in the openings 114 of the fixture 110.

Then, the anode substrate 5 is put on the fixture 110 in which the glass fibers 101 having the transfer paste 121 transferred thereto as described above are held while being registered or positionally aligned therewith, so the glass fibers 101 each are contacted at one end thereof with a predetermined position on the anode substrate 5. Then, the anode substrate 5 is subject to calcination at a predetermined temperature to melt the transfer paste 121, resulting in each of the glass fibers 101 being bonded at the one end thereof to the anode substrate 5.

The transfer paste 121 mainly consists of frit glass of a low softening point in which lead is incorporated so as to permit the transfer paste 121 to have a thermal expansion coefficient approaching to that of the anode substrate 5 made of glass. Also, the transfer paste 121 contains an additional ingredient such as resin or the like as desired, resulting in being pasty while being sticky. Then, the transfer paste 121 is calcined, so that resin and the like contained in the paste are dissipated, to thereby provide the seal glass 4.

The luminous sections 6 are formed on a substantially whole surface of the anode substrate 5 and each of portions of the anode substrate 5 onto which the glass fibers 101 are fixed is defined between the luminous sections 6.

Subsequently, the transfer paste 121 is transferred to one end of each of the spacers 3 thus provided by the glass fibers 101 which are bonded at one end thereof to the anode substrate 5 while being spaced from each other at predetermined intervals. For this purpose, the glass substrate 120 having the transfer paste 121 applied thereto is contacted with one end of each of the spacers 3. Then, the cathode substrate 1 is registered or positionally aligned with the anode substrate 5 and superposed thereon, followed by placing of a combination of the cathode substrate 1 and anode substrate 5 in a furnace for sealing therebetween. This causes the transfer paste 121 to be melted, leading to bonding between the other end of each of the spacers 3 and the cathode substrate 1, so that a hermetic or vacuum envelope may be formed of the anode substrate 5 and cathode substrate 1.

In the vacuum envelope thus formed, the cathode substrate 1 and anode substrate 5 are kept opposite to each other at a predetermined interval. For this purpose, side plates of a predetermined thickness or glass beads or fibers of a predetermined size are interposedly arranged between both substrates 1 and 5 while being positioned at a periphery thereof, followed by sealing. Then, the vacuum envelope thus formed is evacuated to vacuum, resulting in such a display device as shown in FIG. 5 being provided.

In the conventional vacuum envelope constructed as shown in FIG. 5 which has the spacers 3 incorporated therein, electrons discharged from the emitter cones 9 impinge the phosphor layer 6-2 of each of the luminous sections 6 to excite it, leading to luminescence of the phosphor layer, during which electrons are emitted over a considerably wide angular range from the emitter cones 9. This often causes electrons to impinge on a portion of the seal glass 4 by which the spacers 3 are bonded to the anode substrate 5, as shown in FIG. 5. The seal glass 4 contains lead oxide, so that impingement of the electrons on the seal glass 4 causes $Pb^{2+}$ to be reduced, resulting in oxygen (O) being discharged from the seal glass. The oxygen discharged causes oxidation of the tip end of the emitter cones 9, leading to a problem that the emitter cones 9 are deteriorated in emission characteristics.

Also, in the conventional vacuum envelope, transfer of the transfer paste 121 to the spacers 3 often causes the transfer paste 121 to be applied in an excessive amount to the tip end of the spacers 3 due to non-uniform application of the transfer paste 121 onto the glass substrate 120. This leads to a likelihood of disadvantageously increasing a size of a paste pattern formed by transfer of the transfer paste 121 to the spacers 3 to a degree sufficient to cause the paste pattern to be contacted with a pattern of the phosphor layers 6-2. Such contacting causes a portion of the phosphor layer 6-2 contacted with the paste pattern to be changed in properties or deteriorated in luminous characteristics.

Further, the conventional vacuum envelope, as noted from the foregoing, is so constructed that the spacers 3 each are bonded at both ends thereof to the substrates 1 and 5 by means of an adhesive such as the seal glass or the like. Such construction causes manufacturing of the vacuum envelope to be troublesome.

SUMMARY OF THE INVENTION

The present invention has been made in view of the foregoing disadvantage of the prior art.

Accordingly, it is an object of the present invention to provide a vacuum envelope for a display device which is capable of being readily manufactured.

It is another object of the present invention to provide a vacuum envelope for a display device which is capable of effectively preventing contamination of an electron source irrespective of arrangement of spacers between a cathode substrate and an anode substrate.

It is a further object of the present invention to provide a vacuum envelope for a display device which is capable of keeping a phosphor layer from being deteriorated in properties or luminous characteristics.

In accordance with one aspect of the present invention, a vacuum envelope for a display device is provided. The vacuum envelope includes two glass substrate, spacers arranged between the glass substrates so as to oppositely space the glass plates from each other at a predetermined interval, and a sealing member arranged at a periphery of the glass substrates. The spacers each are formed of transparent glass fibers cut into a predetermined length.

In a preferred embodiment of the present invention, the spacers are firmly interposedly held between the two glass substrates by evacuating the vacuum envelope to a vacuum while keeping each of the spacers fixed at one end thereof to a cathode substrate by means of an adhesive.

In a preferred embodiment of the present invention, the adhesive is an organic adhesive. Alternatively, the adhesive may be a glass adhesive.

In a preferred embodiment of the present invention, the spacers are arranged at a raising angle set to be 90±5 degrees with respect to the cathode substrate.

In accordance with another aspect of the present invention, a method for manufacturing a vacuum envelope for a display device is provided. The method comprises the steps of fixing a plurality of glass fibers on a substrate and cutting the glass fibers into a predetermined length by means of a dicing saw; raising the cut glass fibers on a fixture including a raising section provided with openings, a perforated section provided at a bottom of the raising section and an evacuation section which permits gas introduced from the openings of the raising section through the perforated section into the fixture to be exhausted therethrough to an exterior of the fixture; applying an adhesive to a tip end of the glass fibers raised on the fixture; placing one of the glass substrates on the glass fibers to bond the glass fibers to the one glass substrate; calcining the glass substrates; applying a sealing member to a periphery of the glass substrates while rendering the glass substrates opposite to each other, followed by calcination of the glass substrates, leading to sealing between the glass substrates, resulting in providing a vacuum envelope; and evacuating the vacuum envelope through an evacuation hole provided at the envelope to form a vacuum in the vacuum envelope.

In a preferred embodiment of the present invention, the one glass substrate is a cathode substrate and the other of the glass substrates is an anode substrate.

In a preferred embodiment of the present invention, the adhesive may be an organic adhesive, or a glass adhesive.

In a preferred embodiment of the present invention, the sealing member is a paste mainly consisting of frit glass of a low melting point.

In the present invention constructed as described above, the spacers are fixedly bonded to only the cathode substrate, to thereby eliminate a likelihood that the seal glass for the bonding is irradiated with electrons and the phosphor layer is deteriorated in luminous characteristics.

Also, the present invention is so constructed that the spacers each are temporarily fixed at one end thereof to one of the substrates. Such construction keeps any seal glass from being used as a fixing means for the spacers, to thereby eliminate a likelihood of causing oxygen to be released from the seal glass due to irradiation of electrons to the seal glass.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein;

FIG. 6(*b*) is a schematic view showing a compressing angle or rising angle of a spacer.

DETAILED DESCRIPTION OF THE PREFERRED EMBODIMENTS

Now, a vacuum envelope for a display device according to the present invention will be described hereinafter with reference to FIGS. 1(*a*) to 2, as well as FIGS. 6(*a*) to 7(*c*).

Figure 2:
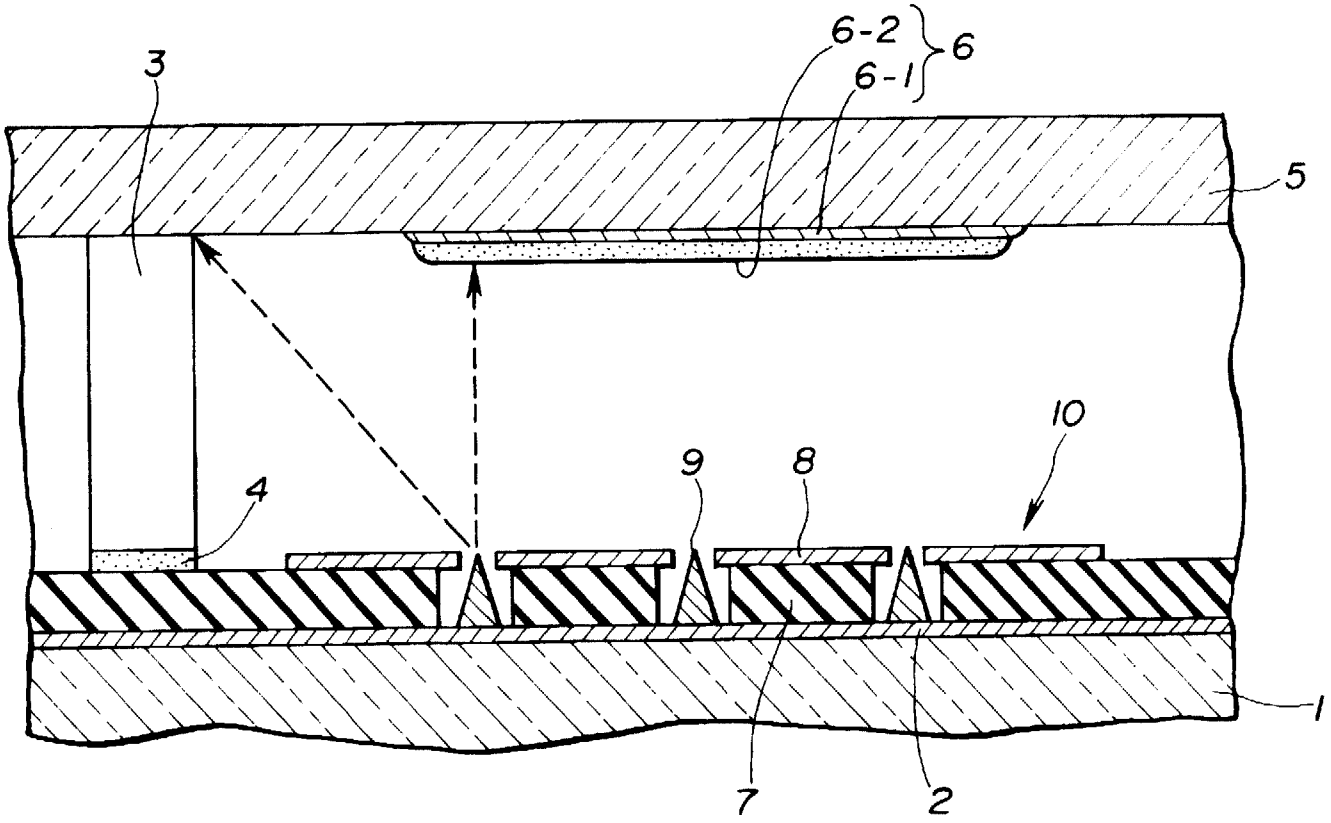
FIG. 2 is a fragmentary sectional view showing each of embodiments of a vacuum envelope for a display device according to the present invention.

Referring first to FIG. 2, a first embodiment of a vacuum envelope for a display device according to the present invention is illustrated. A vacuum envelope of the illustrated embodiment includes a cathode substrate 1, which is formed on an inner surface thereof with a cathode conductor 2 by sputtering or the like. Also, the vacuum envelope of the illustrated embodiment includes an anode substrate 5 made of a transparent material and spacers 3 arranged between the cathode substrate 1 and the anode substrate 5 so as to maintain an interval of a predetermined distance therebetween. Reference numeral 4 designates seal glass for bonding each of the spacers 3 to the cathode substrate 1. The anode substrate 5 cooperates with the cathode substrate 1 to provide a vacuum envelope, which is then evacuated to high vacuum. The anode substrate 5 is provided on an inner surface thereof with luminous sections 6, each of which includes an anode conductor 6-1 arranged on the anode substrate 5 and a phosphor layer 6-2 deposited on the anode conductor 6-1 and adapted to be excited by electrons, leading to luminescence. The cathode conductor 2 is laminatedly formed thereon with an insulating layer 7, which has gate conductors 8 laminatedly arranged thereon. Reference numeral 9 designates emitter cones formed into a conical shape and arranged on the cathode conductor 2 in such a manner that a tip end thereof is positioned opposite to the gate conductor 8. The cathode conductor 2, the insulating layer 7, each of the gate conductor 8 and the emitter cones 9 cooperate with each other to constitute a Spindt-type field emission cathode (FEC) array 10.

Now, the manner of operation of the display device received in the vacuum envelope constituted by the cathode substrate 1 and anode substrate 5 described above will be described hereinafter.

When a positive voltage of a magnitude predetermined with respect to the cathode conductor 2 is applied to the gate conductor 8, the emitter cones 9 are caused to emit electrons through the tip end thereof. The electrons are accelerated by an electric field generated from the anode conductor 6-1 to which a positive voltage is applied in relation to the gate conductor 8, resulting in impinging on the phosphor layer 6-2. This results in the phosphor layer 6-2 being excited, leading to luminescence. The luminescence may be observed through the transparent anode substrate 5.

The vacuum envelope of the illustrated embodiment, as described above, is so constructed that the spacers 3 each are securely bonded at one end thereof to the insulating layer 7 formed on the cathode substrate 1 by melting of the seal glass 4. The other end of each of the spacers 3 is merely abutted against the anode substrate 5 without using melting of the seal glass 4.

Thus, the vacuum envelope of the illustrated embodiment, even when electrons are emitted over a wide angular range from the emitter cones 9 as indicated at broken lines in FIG. 2, substantially keeps the electrons from traveling to the seal glass 4 applied for bonding the spacers 3 to the cathode substrate 1, to thereby prevent release of oxygen from the seal glass 4 containing lead oxide, resulting in contamination of the tip end of the emitter cones 9 with oxygen being effectively prevented.

The construction of the illustrated embodiment wherein the seal glass 4 is not arranged at the end of each of the spacers 3 positioned on a side of the anode substrate 5 prevents contact between a pattern of the seal glass 4 and that of the phosphor layer 6-2, to thereby keep properties or luminous characteristics of the phosphor from being deteriorated during calcination of the seal glass 4.

Figure 3A:
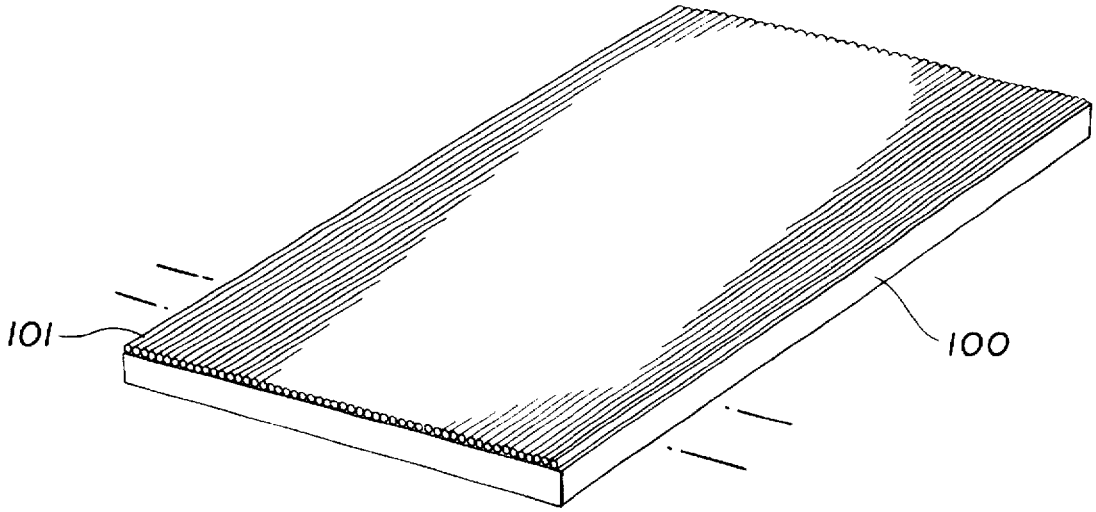
FIG.3(a) PRIOR ART
FIGS. 3(*a*) to 3(*c*) each are a schematic view showing a procedure of manufacturing a conventional vacuum envelope for a display device.
Figure 3B:
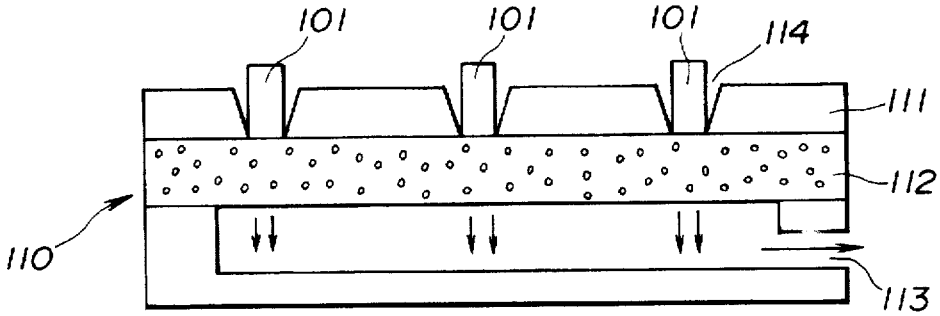
FIG.3(b) PRIOR ART
Figure 3C:
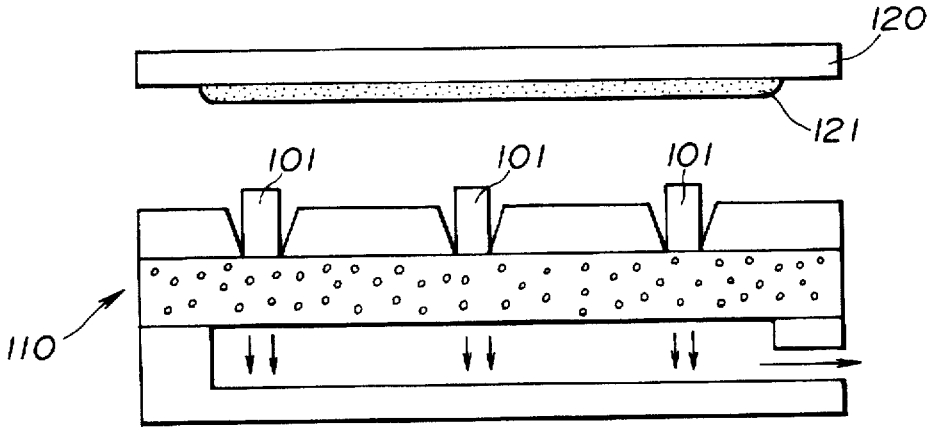
FIG.3(c) PRIOR ART
Figure 4A:
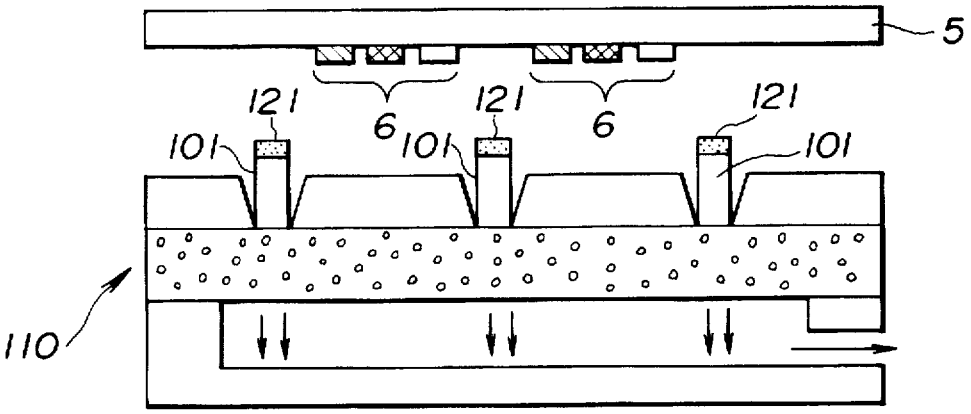
FIG.4(a) PRIOR ART
FIGS. 4(*a*) to 4(*c*) each are a schematic view showing a procedure of manufacturing a conventional vacuum envelope for a display device.
Figure 4B:
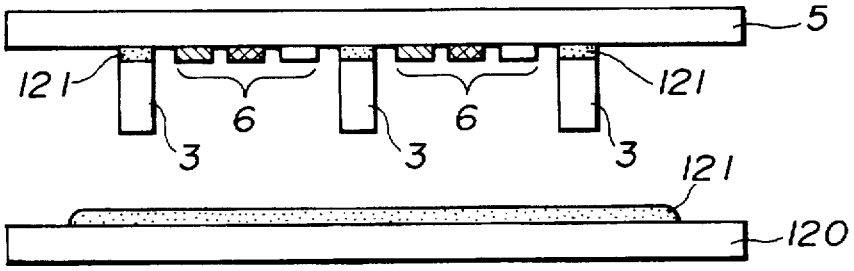
FIG.4(b) PRIOR ART
Figure 4C:
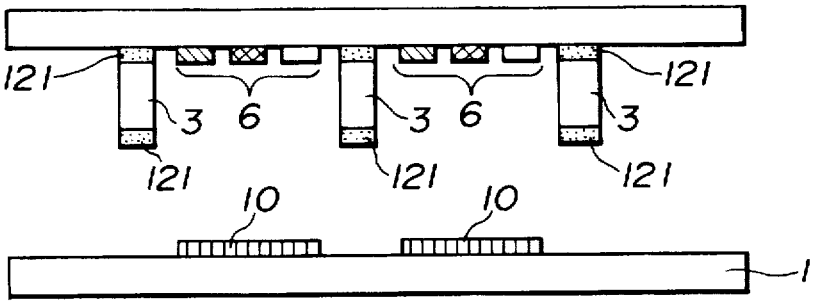
FIG.4(c) PRIOR ART
Figure 5:
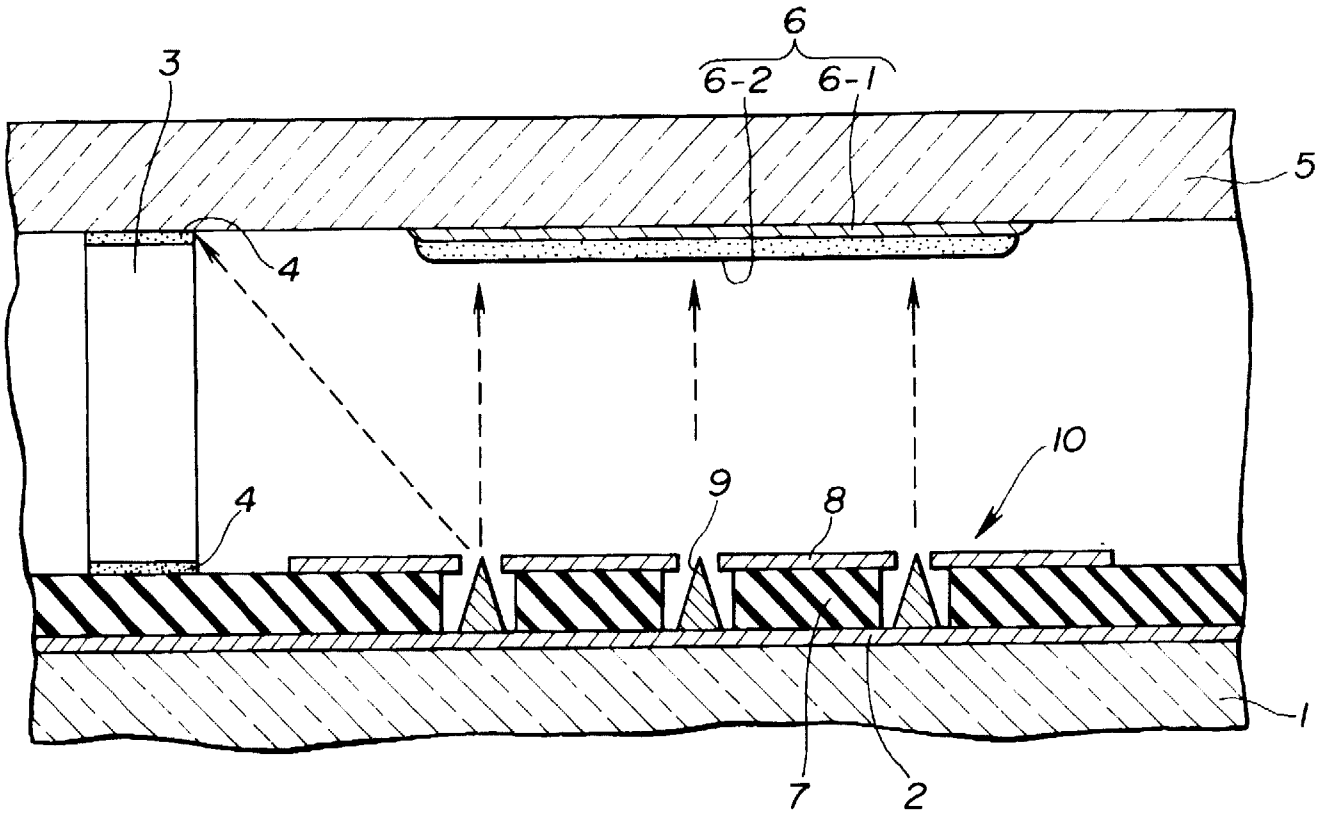
FIG.5 PRIOR ART
FIG. 5 is a fragmentary sectional view showing a conventional vacuum envelope for a display device.

Now, the manner of arrangement of the spacers 3 in the vacuum envelope of the illustrated embodiment will be described hereinafter. The following description will be made on steps subsequent to that shown in FIG. 3(*c*) with reference to FIGS. 1(*a*) and 1(*b*), because such steps of the prior art as shown in FIGS. 3(*a*) and 3(*b*) are likewise applied to the illustrated embodiment.

The spacers 3 made of glass fibers and held in openings 114 provided at a raising section 111 of a fixture 110 while being kept raised each have seal glass (transfer paste) 4 transferred to a distal end thereof. Then, the cathode substrate 1 is registered or positionally aligned with the spacers 3 as shown in FIG. 1(*a*) and then contacted with the spacers 3, followed by interruption of evacuation through the evacuation section 113 of the fixture 110, resulting in the spacers 3 being attached to the cathode substrate 1.

Then, the cathode substrate 1 is subject to calcination while keeping such a state, so that the seal glass 4 is melted to cause the spacers 3 to be bonded at one end thereof to the cathode substrate 1.

Figure 1A:
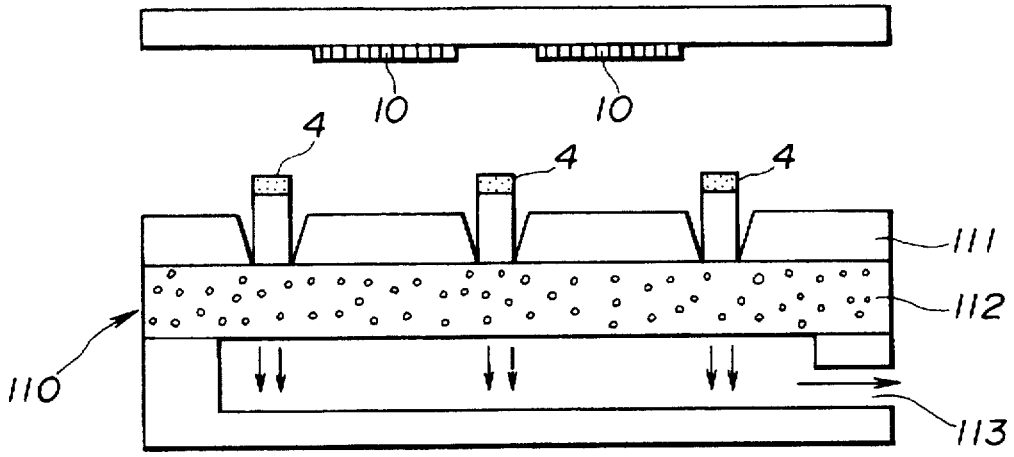
FIGS. 1(*a*) and 1(*b*) each are a schematic view showing a procedure of manufacturing a vacuum envelope for a display device according to the present invention.
Figure 1B:
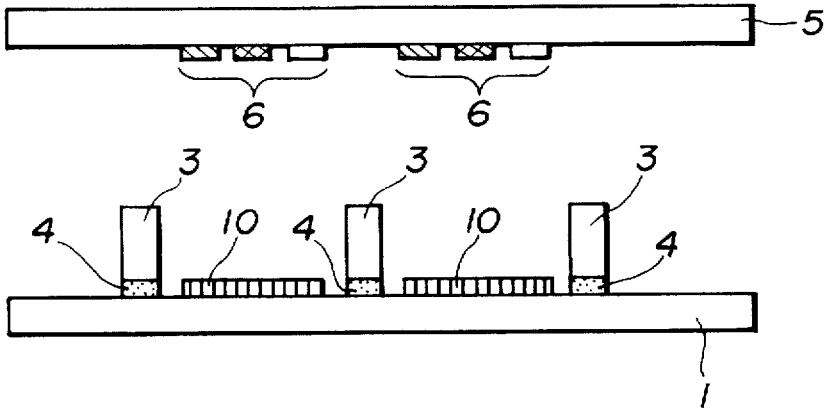

Subsequently, the anode substrate 5 is registered with the cathode substrate 1 having the spacers 3 thus bonded thereto and then put on the cathode substrate 1, as shown in FIG. 1(*b*). In this instance, a combination of seal glass and side plates or a combination of seal glass and glass beads or glass fibers (not shown) is arranged between the cathode substrate 1 and the anode substrate 5 while being positioned at a periphery of the substrates, to thereby keep both substrates spaced from each other at a predetermined interval. This results in the cathode substrate 1 and anode substrate 5 being arranged opposite to each other with a predetermined gap being constantly defined therebetween.

Then, a combination of the cathode substrate 1 and anode substrate thus put on the cathode substrate 1 is introduced into an oven for sealedly joining both to each other. This results in the seal glass arranged at the periphery of the substrates 1 and 5 being melted to carry out sealed joining between both substrates, to thereby provide the vacuum envelope. After the sealing is completed, followed by cooling of the vacuum envelope, it is evacuated through an evacuation pipe or evacuation port (not shown), resulting in high vacuum being formed therein.

Such formation of a high vacuum environment in the vacuum envelope causes an atmospheric pressure to forcibly press the cathode substrate 1 and anode substrate 5 in directions approaching each other, so that the spacers 3 arranged between the cathode substrate 1 and the anode substrate 5 so as to define a predetermined interval therebetween are firmly interposedly held between both substrates 1 and 5. This results in the cathode substrate 1 and anode substrate 5 being stably held with respect to each other with the predetermined interval being positively maintained therebetween.

There may possibly occurs a variation in height of the spacers 3. Such a variation can be absorbed or neglected by melting of the seal glass 4 adhered to one end of the spacers 3.

The spacers 3 mainly act to exhibit rigidity or strength sufficient to permit the vacuum envelope to withstand or resist an ambient atmospheric pressure applied thereto. It was found that such pressure resistance of the vacuum envelope substantially depends on an inclination of the spacers 3.

Figure 6A:
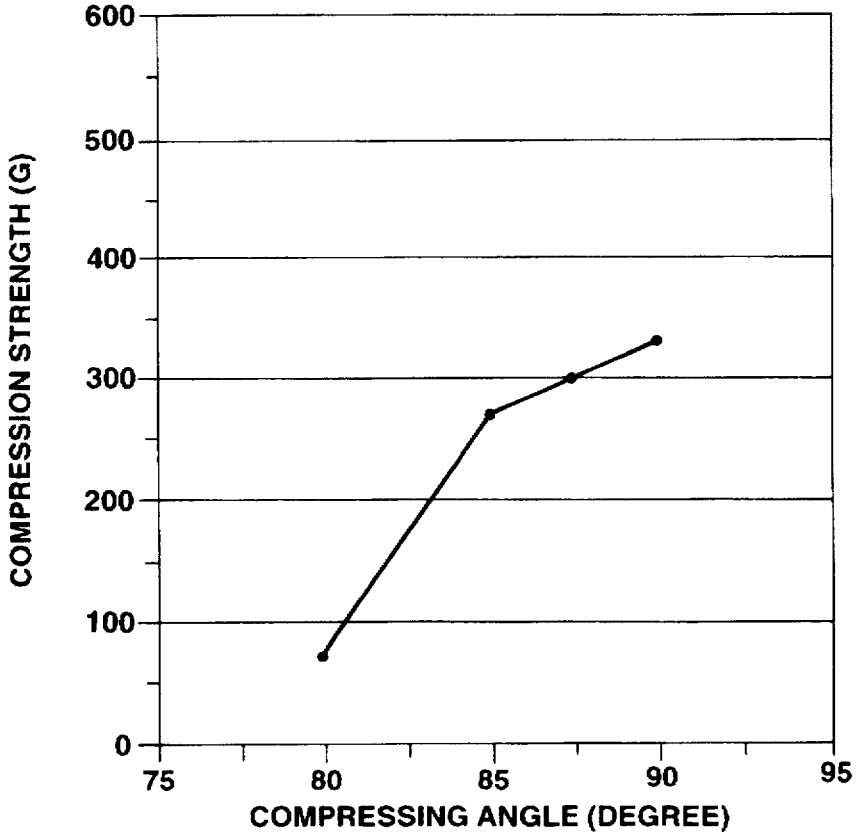
FIG. 6(*a*) is a graphical representation showing relationship between a compressing angle or rising angle of a spacer and a compression strength thereof.
Figure 6B:
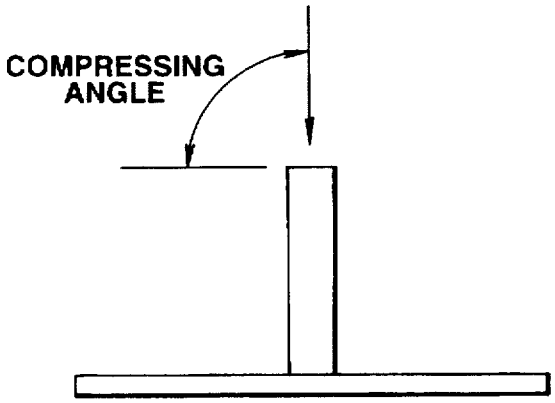

FIG. 6(*a*) shows relationship between an inclination of the spacers 3 and compression strength thereof which was obtained through an experiment by the inventors, wherein an axis of abscissas indicates a rising angle of the spacer 3 in a vertical direction shown in FIG. 6(*b*) and an axis of ordinates indicates compression strength of the spacer. The experiment took place on the assumption that the spacers 3 are fixed at one end thereof on a support.

FIG. 6(*a*) indicates that the spacer 3 exhibits maximum compression strength when the rising angle is 90 degrees or the post 3 is arranged so as to extend in the vertical direction. Also, it indicates that the compression strength exhibited by the the spacer when the rising angle is 80 degree is about one fifth as large as that obtained at the rising angle of 90 degrees. Further, it will be noted that there is no significant difference between the compression strength obtained at the rising angle of 85 degrees and that at 90 degrees.

In view of the above, the illustrated embodiment in which only one end of the spacers 3 is bonded to the substrate defines the rising angle at 90±5 degrees, to thereby ensure satisfactory pressure resistance of the envelope.

In addition, a further experiment by the inventors revealed that use of a glass fiber material of a low softening point for the spacers 3 leads to softening of the spacers 3 during sealing between both substrates 1 and 5, to thereby permit a variation in height or length of the spacers 3 up to about 10 um to be effectively absorbed.

The spacers 3 of which a rising angle is set to be within a range of 90±5 degrees and a variation in length is limited to 10 μm or less may be satisfactorily prepared according to such a conventional procedure as described above with reference to FIG. 3(*a*).

Alternatively, the glass fibers for the spacers 3 may be prepared by subjecting a photo-sensitive glass plate of about 200 μm in thickness to exposure and etching by means of a circular mask pattern of about 50 μm in diameter. In this instance, a length of the spacers is determined depending on a variation in thickness of the photo-sensitive glass plate, so that the variation is limited to about 5 μm or less when the photo-sensitive glass plate of 100 mm×100 mm in size is used. Also, an inclination angle or rising angle of the spacers 3 depends on an angle of incidence of light with respect to the photo-sensitive glass plate, resulting in being set or determined with high accuracy.

The illustrated embodiment, as described above, is so constructed that the spacers are bonded to the insulating layer formed on the cathode substrate. Alternatively, the spacers may be bonded directly to the cathode substrate without interposedly arranging the insulating layer and cathode conductor therebetween. Also, the spacers may be bonded directly to the cathode substrate without arranging the insulating layer therebetween.

Now, a second embodiment of a vacuum envelope for a display device according to the present invention will be described hereinafter likewise with reference to FIG. 2.

A vacuum envelope of the illustrated or second embodiment includes a cathode substrate 1, which is formed on an inner surface thereof with a cathode conductor 2 by sputtering or the like. Also, the vacuum envelope of the second embodiment includes an anode substrate 5 made of a transparent material and spacers 3 arranged between the cathode substrate 1 and the anode substrate 5 so as to maintain an interval of a predetermined distance therebetween. Reference numeral 4 designates acrylic resin (residue) for temporarily bonding each of the spacers 3 to the cathode substrate 1. The anode substrate 5 cooperates with the cathode substrate 1 to provide a vacuum envelope, which is then evacuated to a high vacuum. The anode substrate 5 is provided on an inner surface thereof with luminous sections 6, each of which includes an anode conductor 6-1 arranged on the anode substrate 5 and a phosphor layer 6-2 depositedly formed on the anode conductor 6-1 and adapted to be excited for luminescence by electrons. The cathode conductor 2 is laminatedly formed thereon with an insulating layer 7, which has gate conductors 8 laminatedly arranged thereon. Reference numeral 9 designates emitter cones formed into a conical shape and arranged on the cathode conductor 2 in such a manner that a tip end thereof is positioned opposite to the gate conductor 8. The cathode conductor 2, the insulating layer 7, each of the gate conductors 8 and emitter cones 9 cooperate with each other to constitute each of Spindt-type field emission cathode (FEC) arrays 10. The remaining part of the second embodiment may be constructed in substantially the same manner as the first embodiment described above.

Now, the manner of operation of the display device received in the vacuum envelope constituted by the cathode substrate 1 and anode substrate 5 as described above will be described hereinafter.

When a positive voltage of a magnitude predetermined with respect to the cathode conductor 2 is applied to the gate conductor 8, the emitter cones 9 are excited to emit electrons through the tip end thereof. The electrons are accelerated by an electric field generated from the anode conductor 6-1 to which a positive voltage is applied in relation to the gate conductor 8, resulting in impinging on the phosphor layer 6-2. This results in the phosphor layer 6-2 being excited, leading to luminescence. Luminescence of the phosphor layer thus obtained may be observed through the transparent anode substrate 5.

In the vacuum envelope of the second embodiment, the spacers 3 are merely temporarily bonded onto the insulating layer 7 arranged on a side of the cathode substrate 1 by means of the acrylic resin 4, thus, the spacers are merely interposedly held between the cathode substrate 1 and the anode substrate 5.

Such construction of the illustrated embodiment, even when the emitter cones 9 emit electrons over a wide angular range as indicated at broken lines in FIG. 2, substantially keeps the tip end of the emitter cones 9 from being contaminated with oxygen, because the vacuum envelope is free of any oxygen-containing seal glass which inherently releases or produces oxygen due to impingement of electrons thereon.

Also, the spacers 3 are merely abuttedly contacted with the anode substrate 5 without using any fixing means such as seal glass or the like, to thereby prevent contacting between the fixing means and a pattern of the phosphor layer 6-2, resulting in keeping the phosphor layer 6-2 from being deteriorated in luminous characteristics.

Now, the manner of arrangement of the spacers 3 in the vacuum envelope of the illustrated embodiment will be described. The following description will be made on steps subsequent to that shown in FIG. 3(*c*) with reference to FIGS. 7(*a*) to 7(*c*), because such steps of the prior art as shown in FIGS. 3(*a*) and 3(*b*) are likewise applied to the illustrated embodiment.

Glass fibers 101 for the spacers 3 are held in openings 114 provided at a raising section 111 of a fixture 110 while being kept raised and a glass plate 120 having the acrylic resin 4 applied all over one surface thereof is put on the fixture 110 and contacted with a tip end of the glass fibers 101, to thereby coat the tip end of the glass fibers 101 with the acrylic resin 4. Thus, the acrylic resin 4 is transferred to the tip end of the glass fibers 101. Then, the cathode substrate 1 is put on the fixture 110 while being registered or positionally aligned with the fixture 100 as shown in FIG. 7(*b*), followed by interruption of evacuation through the evacuation section 113 of the fixture 110, resulting in the glass fibers 101 being attached in the form of the spacers 3 to the cathode substrate 1.

Then, the cathode substrate 1 is subject to calcination at a temperature of about 480° C. in such a state, so that the acrylic resin 4 may be burned out to leave a residue, during which the spacers 3 are kept temporarily held on the cathode substrate 1 by the acrylic resin (residue) 4.

Figure 7A:
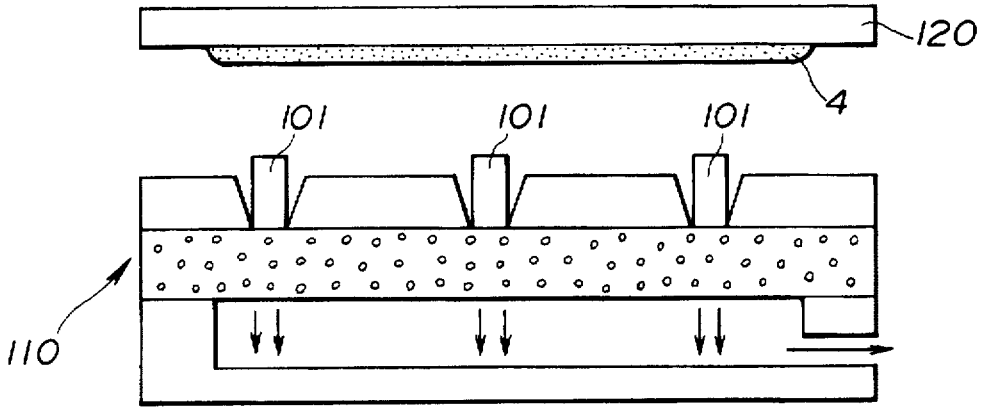
FIGS. 7(*a*) to 7(*c*) each are a schematic view showing a procedure of manufacturing a vacuum envelope for a display device according to the present invention.
Figure 7B:
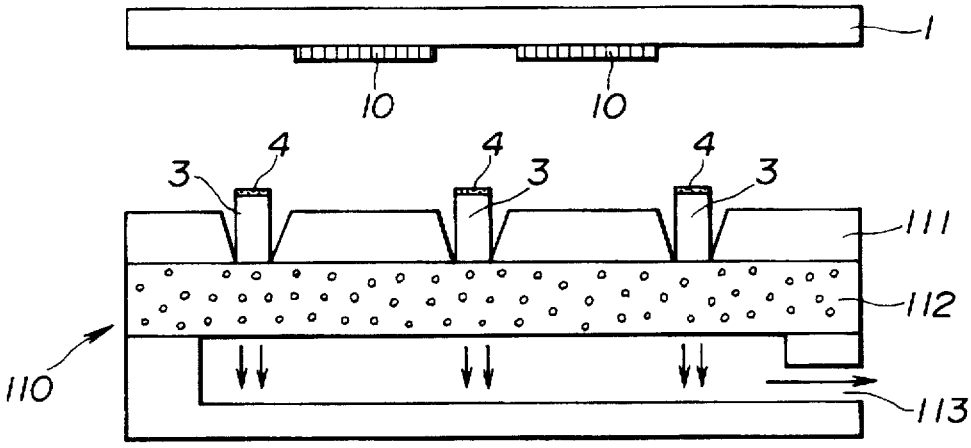
Figure 7C:
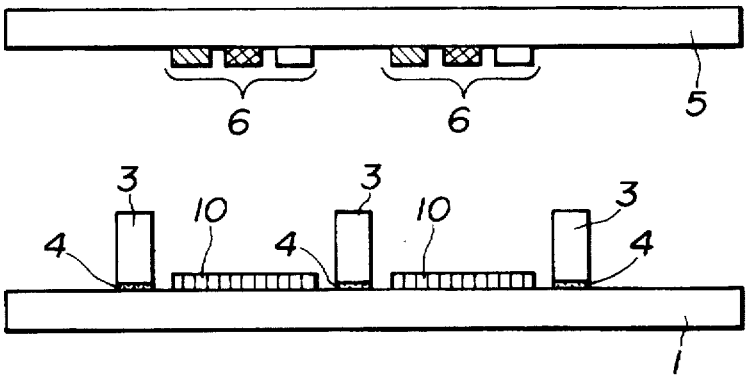

Thereafter, the anode substrate 5 is put on the cathode substrate 1 having the spacers 3 thus temporarily held thereon while being registered therewith, as shown in FIG. 7(*c*). In this instance, a combination of seal glass and side plates of a predetermined thickness or a combination of seal glass and glass beads or glass fibers (not shown) is arranged between the cathode substrate 1 and the anode substrate 5 while being positioned at a periphery of the substrates, to thereby keep both substrates spaced from each other at a predetermined interval. This results in the cathode substrate 1 and anode substrate 5 being arranged opposite to each other with a predetermined gap being uniformly defined therebetween.

Then, a combination of the cathode substrate 1 and anode substrate 5 thus put on the cathode substrate 1 is introduced into an oven for sealedly joining both to each other. This results in the seal glass arranged at the periphery of the substrates 1 and 5 being melted to carry out sealed joining between both, to thereby provide the vacuum envelope. After the sealing is completed, followed by cooling of the vacuum envelope, it is evacuated through an evacuation pipe or evacuation port (not shown), resulting in high vacuum being formed therein.

Such formation of a high vacuum environment in the vacuum envelope causes an atmospheric pressure to inwardly pressedly force the cathode substrate 1 and anode substrate 5, so that the spacers 3 arranged between the cathode substrate 1 and the anode substrate 5 so as to define a predetermined interval therebetween are firmly interposedly held between both substrates 1 and 5. This results in the cathode substrate 1 and anode substrate 5 being stably held with respect to each other with the predetermined interval being uniformly maintained therebetween.

The acrylic resin 4 may consist of an acrylic resin ingredient of high-temperature decomposition characteristics and a solvent for the acrylic resin ingredient.

There may possibly occurs a variation in height of the spacers 3 prepared. Such a variation leads to a disadvantage of causing the spaces 3 of a reduced height to be loosened. In order to solve the problem, the spacers 3 are made of a material which is softened during sealing between both substrates, to thereby absorb the variation. More specifically, the spacers 3 are made of a glass fiber material of a low softening point.

The illustrated embodiment is so constructed that the spacers are temporality fixed to the insulating layer formed on the cathode substrate. Alternatively, the spacers may be temporarily fixed directly to the cathode substrate without interposedly arranging the insulating layer and cathode conductor therebetween. Also, the spacers may be temporarily fixed directly to the cathode substrate without arranging the insulating layer therebetween. Also, the spacers may be temporarily fixed to a side of the anode substrate rather than the cathode substrate.

As can be seen from the foregoing, the vacuum envelope of the present invention may be constructed in the manner that the spacers each are bonded to only the cathode substrate. Such construction effectively prevents the bonded portion of the spacers from being irradiated with electrons and the phosphor layer from being deteriorated in luminous characteristics.

Also, in the vacuum envelope of the present invention, the spacers are arranged at an inclination or rising angle set within a predetermined or limited angular range which permits the vacuum envelope to exhibit satisfactory pressure resistance. Thus, the present invention permits a display device including the vacuum envelope of the present invention to carry out uniform luminous display. Further, the present invention is constructed so as to absorb a variation in length between the spacers, to thereby prevent loosening of the spacers in the envelope.

In addition, the vacuum envelope of the present invention may be so constructed that the spacers are temporarily fixed to any one of the substrates. Such construction eliminates a necessity of using any seal glass for the fixing, to thereby eliminate release of oxygen due to irradiation of electrons to the fixed portion of the spacers and prevent the phosphor layer from being deteriorated in luminous characteristics. Also, this permits the vacuum envelope to be simplified in structure.

Further, the present invention permits the spacers to be be firmly interposedly held between the anode substrate and the cathode substrate by an atmospheric pressure, to thereby ensure that a desired interval is uniformly maintained therebetween.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A vacuum envelope for a display device comprising:

an anode and a cathode substrates;

a field emission array structure formed on said cathode substrate, said field emission array structure including a cathode conductor, a dielectric insulating layer, conical emitter cones and a gate conductor surrounding said conical emitter cones;

a phosphor coated screen formed on said anode substrate, said screen including an anode conductor formed on said anode substrate and a phosphor layer deposited on said anode conductor;

spacers arranged between said anode and cathode substrates so as to oppositely space said anode and cathode substrates from each other at a predetermined interval; and a sealing member arranged at a periphery of said cathode substrate;

said spacers each being formed of transparent glass fibers cut into a predetermined length, with said length extending between said anode and cathode substrates, said spacers being fixed to said cathode substrate by an adhesive at one cutting end thereof and said anode substrate by atmospheric pressure exerted on said envelope as a result of vacuum created in said envelope at another cutting end thereof.

2. A vacuum envelope as defined in claim 1, wherein said adhesive is an organic adhesive.

3. A vacuum envelope as defined in claim 1, wherein said adhesive is a glass adhesive.

4. A vacuum envelope as defined in claim 1, wherein said spacers are arranged at a raising angle set to be 90±5 degrees with respect to said cathode substrate.

* * * * *